US009341049B2

(12) United States Patent
Hailey, Jr. et al.

(10) Patent No.: US 9,341,049 B2
(45) **Date of Patent: *May 17, 2016**

(54) CONTROLLED PRODUCTION AND INJECTION

(71) Applicant: Halliburton Energy Services, Inc., Houston, TX (US)

(72) Inventors: Travis Thomas Hailey, Jr., Sugar Land, TX (US); Geirmund Saetre, Hafrsfjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

This patent is subject to a terminal disclaimer.

(21) Appl. No.: 13/886,858

(22) Filed: May 3, 2013

(65) Prior Publication Data

US 2013/0255952 A1 Oct. 3, 2013

Related U.S. Application Data

(63) Continuation of application No. 13/094,051, filed on Apr. 26, 2011, now Pat. No. 9,074,466.

(51) Int. Cl.
*E21B 43/14* (2006.01)
*E21B 43/12* (2006.01)

(52) U.S. Cl.
CPC ..... *E21B 43/14* (2013.01); *E21B 43/12* (2013.01)

(58) Field of Classification Search
CPC ..... E21B 34/08; E21B 34/10; E21B 43/08; E21B 43/12; E21B 43/14
See application file for complete search history.

(56) References Cited

U.S. PATENT DOCUMENTS

| | | | |
|---|---|---|---|
| 3,375,842 | A | 4/1968 | Reader |
| 3,461,897 | A | 8/1969 | Kwok |
| 6,427,775 | B1 | 8/2002 | Dusterhoft et al. |
| 6,481,494 | B1 | 11/2002 | Dusterhoft et al. |
| 6,488,082 | B2 | 12/2002 | Echols et al. |
| 6,516,881 | B2 | 2/2003 | Hailey, Jr. |
| 6,540,022 | B2 | 4/2003 | Dusterhoft et al. |
| 6,543,545 | B1 | 4/2003 | Chatterji et al. |
| 6,557,634 | B2 | 5/2003 | Hailey, Jr. et al. |
| 6,571,872 | B2 | 6/2003 | Dusterhoft et al. |
| 6,581,689 | B2 | 6/2003 | Hailey, Jr. |
| 6,675,891 | B2 | 1/2004 | Hailey, Jr. et al. |
| 6,715,545 | B2 | 4/2004 | McGregor et al. |
| 6,719,051 | B2 | 4/2004 | Hailey, Jr. et al. |
| 6,766,862 | B2 | 7/2004 | Chatterji et al. |
| 6,769,486 | B2 | 8/2004 | Lim et al. |

(Continued)

OTHER PUBLICATIONS

Authorized officer Nora Lindner, International Preliminary Report on Patentability, PCT Application No. PCT/US2012/032130, Nov. 7, 2013, 8 pages.

(Continued)

*Primary Examiner* — Catherine Loikith
(74) *Attorney, Agent, or Firm* — Scott Richardson; Fish & Richardson P.C.

(57) ABSTRACT

A well production and injection string includes a plurality of spaced apart packers each adapted to seal with a wall of the wellbore. A plurality of flow control devices are provided in the string, distributed between pairs of adjacent packers. The flow control devices are adapted to communicate flow between an interior and an exterior of the string with less restriction to flow from the interior to the exterior of the string than to flow from the exterior to the interior of the string.

30 Claims, 3 Drawing Sheets

(56) References Cited

U.S. PATENT DOCUMENTS

| | | | |
|---|---|---|---|
| 6,782,948 | B2 | 8/2004 | Echols et al. |
| 6,899,176 | B2 | 5/2005 | Hailey, Jr. et al. |
| 6,932,157 | B2 | 8/2005 | McGregor et al. |
| 7,096,945 | B2 | 8/2006 | Richards et al. |
| 7,108,083 | B2 | 9/2006 | Simonds et al. |
| 7,240,739 | B2 | 7/2007 | Schoonderbeek et al. |
| 7,243,724 | B2 | 7/2007 | McGregor et al. |
| 7,367,395 | B2 | 5/2008 | Vidrine et al. |
| 7,451,815 | B2 | 11/2008 | Hailey, Jr. |
| 7,647,966 | B2 | 1/2010 | Cavender et al. |
| 7,708,068 | B2 | 5/2010 | Hailey, Jr. et al. |
| 7,717,175 | B2 | 5/2010 | Chung et al. |
| 7,802,621 | B2 | 9/2010 | Richards et al. |
| 2003/0234111 | A1 | 12/2003 | Echols et al. |
| 2005/0039917 | A1 | 2/2005 | Hailey, Jr. |
| 2006/0037752 | A1 | 2/2006 | Penno et al. |
| 2007/0012444 | A1 | 1/2007 | Horgan et al. |
| 2007/0028977 | A1 | 2/2007 | Goulet |
| 2007/0246225 | A1 | 10/2007 | Hailey, Jr. et al. |
| 2007/0246407 | A1 | 10/2007 | Richards et al. |
| 2007/0272408 | A1 | 11/2007 | Zazovsky et al. |
| 2008/0283238 | A1 | 11/2008 | Richards et al. |
| 2009/0000787 | A1 | 1/2009 | Hill et al. |
| 2009/0288838 | A1 | 11/2009 | Richards |
| 2011/0042091 | A1 | 2/2011 | Dykstra et al. |
| 2011/0139453 | A1 | 6/2011 | Schultz |
| 2011/0308806 | A9 | 12/2011 | Dykstra et al. |

OTHER PUBLICATIONS

Examination Report, GCC Patent Office, GCC Patent Application No. GC 2012-21081, Dec. 24, 2014, 4 pages.

Canadian Office Action, Canadian Patent Office, Canadian Patent Application No. 2,834,294, Jan. 9, 2015, 4 pages.

Halliburton, "EquiFlow® Inflow Control Devices" 2009, 2 pages.

Halliburton, "EquiFlow® Inject System" 2009, 2 pages.

Halliburton, "Halliburton Screens" 10 pages.

Reslink, "ResFlow Well Production Management System" 2007, 4 pages.

Reslink, "ResInject Well Production Management System" 2007, 2 pages.

Authorized officer Bonghoon Lee, International Search Report and Written Opinion in International Application No. PCT/US2012/032130, mailed Jan. 14, 2013, 12 pages.

Tesar et al., "New Ways of Fluid Flow Control in Automobiles: Experience with Exhaust Gas Aftertreatment Control", Seoul 2000 FISITA World Automotive Congress, Jun. 12-15, 2000, 8 pages.

Tesar, "Sampling by Fluidics and Microfluidics", Acta Polytechnica, vol. 42, No. 2/2002, published in 2002, 9 pages.

Australian Patent Examination Report 1, Jun. 22, 2015, 4 pages.

CONTROLLED PRODUCTION AND INJECTION

BACKGROUND

The present disclosure relates to producing resources from a subterranean zone.

Often, an injection treatment will be applied to a well prior to putting the well on production or at some point during production. Some example injection treatments include acidizing or solvent injection to remove near wellbore damage, steam injection to mobilize resources in a formation, and water or polymer-laden fluid sweeping to pressurize and sweep resources in a reservoir to a desired location. There are other types of injection treatments. Because it is costly and time consuming to run different well strings into and out of a wellbore, the injection treatments are performed with the production string when practicable.

SUMMARY

The present disclosure relates to producing resources from a subterranean zone.

A well production and injection string is described for use in a wellbore. The string includes a plurality of spaced apart packers each adapted to seal with a wall of the wellbore. A plurality of flow control devices are provided in the string, distributed between pairs of adjacent packers. The flow control devices are adapted to communicate flow between an interior and an exterior of the string with less restriction to flow from the interior to the exterior of the string than to flow from the exterior to the interior of the string.

A method of accessing a subterranean zone is described. According to the method, an annulus between a well string and a wellbore is sealed at a plurality of locations. An injection fluid is injected from the well string into the subterranean zone between the plurality of sealed locations through a first flow area that provides a first flow resistance. Production fluid is received from the subterranean zone between the plurality of locations through a second flow area that provides a second, greater flow resistance. In certain instances, the first flow area is reduced to provide the second flow area.

A well system is described. The well system includes a wellbore extending from a terranean surface to a subterranean zone. Additional, the system includes a well string having tubing and a plurality of seals arranged along the tubing. Each of the seals is adapted to seal with a wall of the wellbore. A plurality of flow control devices are arranged along the tubing and distributed between pairs of adjacent seals. The flow control devices are adapted to communicate outflow from an interior to an exterior of the string through a first flow area and inflow from the exterior of the string to the interior of the string through a second, smaller flow area. In certain instances, the first flow area is reduced to provide the second flow area.

In certain instances, the flow control devices can include a plurality of flow passages between an interior and an exterior of the string and a subset of the passages include one-way passages that restrict fluid flow from the exterior to the interior of the string. In certain instances, the one-way passages have check valves adapted to close the passage in response to a pressure differential between the interior and exterior of the string. In certain instances, the flow area to flow from the interior to the exterior of the string is greater than the flow area to flow from the exterior to the interior of the string. The packers or seals can be distributed along substantially the entire production/injection interval of the string. In certain instances, the flow control devices are adapted to provide substantially uniform flow of fluids between the exterior and the interior of the string along the entire production/injection interval. In certain instances, the flow control devices are less restricting to flow between the exterior and interior of the string as the location of the flow is more toward an end of the string. The string can include a plurality of particulate control screens configured to filter against passage of particulate larger than a specified size from the exterior to the interior of the string.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 2A depicts flow from an interior of the string to an exterior of the string, and FIG. 2B depicts the flow control device responding to flow from an exterior of the string.

FIG. 3B depicts flow from an interior of the string to the exterior of the string, and FIG. 3C depicts the flow control device responding to flow from an exterior of the string.

Like reference symbols in the various drawings indicate like elements.

DETAILED DESCRIPTION

Figure 1:
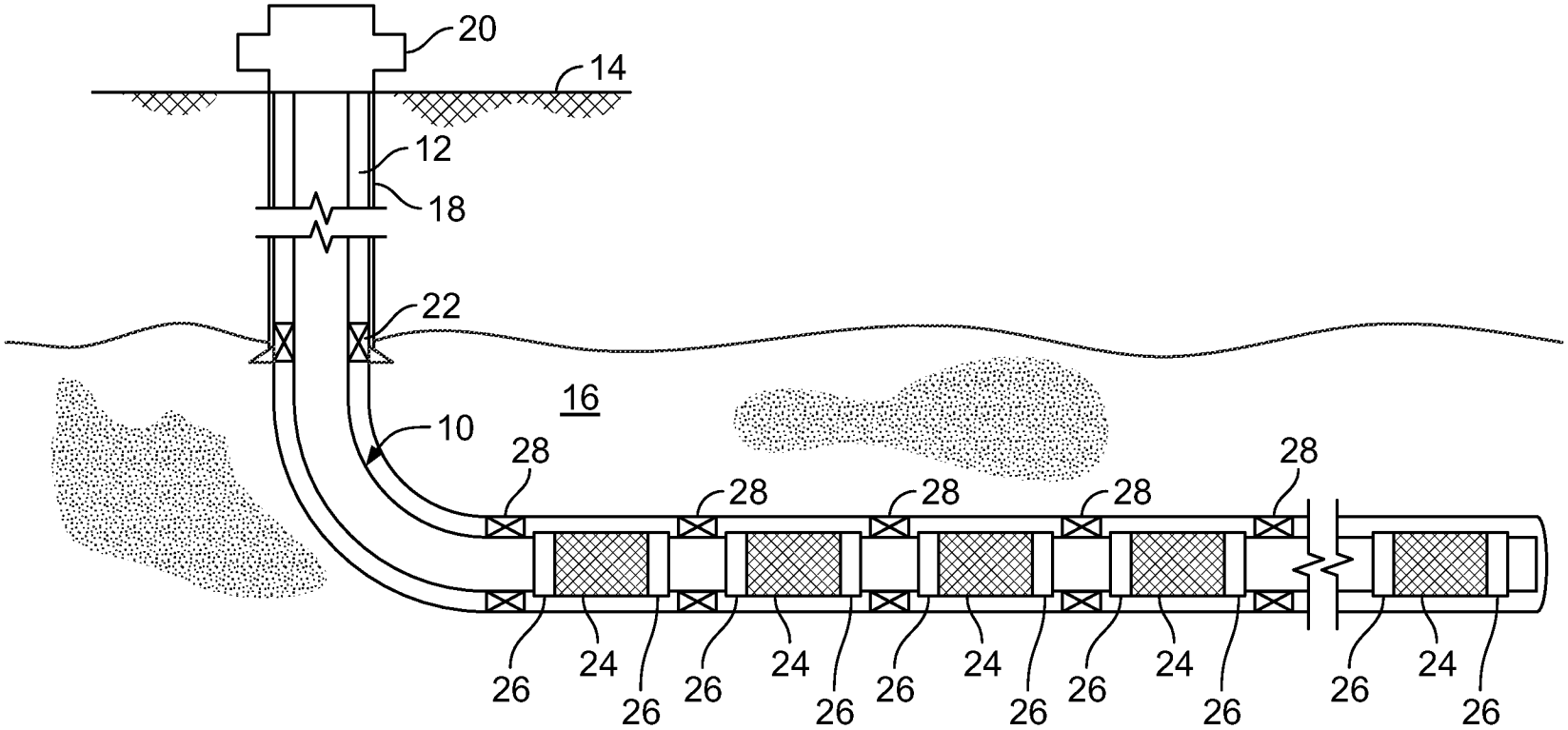
FIG. 1 is a schematic cross-sectional view of an example production/injection string residing in wellbore.

Referring first to FIG. 1, an example production/injection string 10 is shown residing in wellbore 12.

The wellbore 12 extends substantially vertically from a terranean surface 14 into the earth and deviates to substantially horizontal. Although the wellbore 12 is depicted as being substantially horizontal, in other instances, the entire wellbore and/or portions thereof may be vertical or may deviate to be slanted, curved or otherwise non-vertical. Similarly, although the wellbore 12 is depicted as being a single wellbore, in other instances, wellbore 12 can be one of a multilateral wellbore configuration having one or more lateral wellbores extending from a main wellbore. The wellbore 12 provides access to a target subterranean zone 16, where the subterranean zone can correspond to a particular geological formation, can be a portion of a geological formation, or can include two or more geological formations. Casing 18 extends from a wellhead 20 at the surface 14 through a portion of the wellbore 12, typically (but not necessarily) terminating in the subterranean zone 16. In certain instances, the casing 18 is cemented and/or otherwise affixed to the wall of the wellbore 12. In certain instances, the casing 18 is unapertured wall tubing. A portion of the wellbore 12 is depicted as being open hole, without casing 18 and with the surface of the subterranean zone 16 exposed to allow exchange of fluid between the wellbore 12 and the subterranean zone 16. In other instances, the entire wellbore 12 can be cased and the casing 18 provided with apertures or perforations to allow exchange of fluid between the wellbore 12 and the subterranean zone 16.

The example production/injection string 10 includes one or more lengths of tubing and other components sized to be received in (i.e., run-in) the wellbore 12 and operate in injecting fluids into and/or withdrawing (i.e., producing) fluids from the subterranean zone 16. The tubing can be jointed tubing coupled end to end (threadingly and/or otherwise) and/or coiled tubing. Although the specific components and their arrangement in the string can vary from application to application, FIG. 1 depicts an example production/injection string 10 that facilitates description of the concepts herein.

In the example of FIG. 1, the production/injection string 10 includes a production packer 22 positioned in the string 10 to reside proximate the downhole end of the casing 18 when the production/injection string 10 is installed in the wellbore 12. The production packer 22 is actuated (mechanically, hydraulically and/or otherwise) to seal with the casing 18 and prevent passage of fluids through the annulus between the string 10 and casing 18.

The portion of the production/injection string 10 in the subterranean zone 16, downhole of the production packer 22, defines a production/injection interval of the string 10. The production/injection interval is configured to communicate fluids between an interior of the string 10 and the subterranean zone 16, via the wellbore 12. To this end, the string 10 of FIG. 1 includes a plurality of spaced apart particulate control screens 24 with associated flow control devices 26. The flow control devices 26 include flow passages that communicate flow between the interior and exterior of the string 10 and are coupled to communicate with the particulate control screens 24. The particulate control screens 24 filter against passage of particulate larger than a specified size into the passages of flow control devices 26 and the interior of the string 10. For example, the particulate control screens 24 can filter against sand and gravel displaced from the subterranean zone 16 or installed in the wellbore 12 as part of a gravel or frac packing operation.

The string 10 further includes a plurality of spaced apart packers 28 that each are actuated (mechanically, hydraulically and/or otherwise) to seal with a wall of the wellbore 12 and prevent passage of fluids through the annulus between the string 10 and the wall of the wellbore 12. Adjacent pairs of packers 28 define production/injection sub-intervals of the string 10 therebetween, and when actuated to seal with the wall of the wellbore 12, isolate fluid in the annulus of one sub-interval from other sub-intervals. The particulate control screens 24 and flow control devices 26 are positioned in the string 10 between pairs of adjacent packers 28. Thus, all fluid in the annulus of a given sub-interval is constrained to flow into the string 10 through the particulate control screens 24 and associated flow control devices 26 within the sub-interval. Conversely, fluid in the string 10 expelled through the flow control devices 26 and particulate control screens 24 is directed into the subterranean zone 16 between the packers 28 defining the boundaries of the sub-interval. Although FIG. 1 shows one particulate control screen 24 and its associated flow control devices 26 per production/injection sub-interval, more than one could be provided. Also, as described in more detail below, each particulate control screen 24 can be associated with a single flow control device 26 or multiple flow control devices 26 (two shown, but more can be provided). In instances of multiple flow control devices 26 per screen 24, each within a sub-interval may configured alike or differently.

In certain instances, one or more of the flow control devices 26 in a sub-interval can be provided with flow passages that have asymmetrical flow properties between inflow and outflow, e.g., passages that allow outflow and resist or seal against inflow or vice versa. Such asymmetrical flow control devices 26 can be mixed with symmetrical flow control devices 26 or other oppositely flowing asymmetrical flow control devices 26 to provide different inflow and outflow (i.e., injection and production) characteristics in different sub-intervals and along the whole production/injection interval. For example, the rate of outflow of fluid needed for a given injection treatment may be greater than the rate of inflow of fluids produced from the subterranean zone 16. Therefore, to account for this, the arrangement of flow control devices 26 in a string 10 can be configured to offer less resistance to outflow of fluid from the interior to the exterior of the string 10 than to inflow of fluid from the exterior to the interior. Additionally, the injection fluids and fluids produced from the subterranean zone 16 may have different properties that affect how much resistance to flow is needed to achieve a specified flow rate. For example, the injection fluids and production fluids may have different viscosities, be at different pressures, and/or have other different properties. Thus, in addition to accounting for the different amounts of fluid flow, the resistance to inflow or outflow of the flow control devices 26 can be selected to compensate for the different fluid properties to achieve a specified amount of fluid flow.

One manner of providing different resistance to flow is to provide different flow areas through the flow control devices 26, for example, with greater flow area tending to provide less resistance to flow and lesser flow area tending to provide more resistance to flow. Thus, to provide flow control devices with less resistance to outflow than inflow, these flow control devices 26 can have a greater flow area through the flow control device 26 for outflow than for inflow. Also, all the flow control devices 26 in a string, or even in a sub-interval, need not provide the same resistance to inflow and outflow. Rather, different flow control devices 26 in different or the same production/injection sub-intervals can have different resistance to inflow, outflow or both. For example, if a given sub-interval is provided with a flow control device 26 having a one-way fluid passage, a second flow control device 26 having a two-way flow passage or having a one-way fluid passage oriented to flow oppositely of the first flow control device 26 would allow the sub-interval to flow both during injection and production yet have a different flow area (and different flow resistance) depending on the direction of flow. Also, the flow control devices 26 can include devices 26 that each have both one-way or asymmetrical and symmetrical fluid passages.

By selection and arrangement of flow control devices 26, a specified outflow amount and/or inflow amount profile, i.e., in injection and/or production, can be achieved over the entire length of the production/injection interval. In certain instances, the specified flow profile can be substantially uniform radial outflow and inflow over the entire length of the production/injection interval. For example, a desired flow profile for 30 barrels per minute of radial outflow (i.e., injection) during an acid stimulation treatment in a well with 30 production/injection intervals could be a uniform outflow of about 1 barrel per minute per interval, whereas the expected radial inflow (i.e., production) during production of the same well could be 15,000 barrels per day, with uniform inflow of about 0.35 barrel per minute per interval. These flow rates are mentioned merely as an example, and significant variances in uniformity of actual flows, e.g., even 50% variance from strict uniformity, still fall within the bounds of this method as the possible variance of flows without the system and method described here could be much greater than 50% variance and the system and method would therefore move the flows substantially toward uniformity without achieving strict uniformity.

The flow profile can be the same in production as it is in injection or the production flow profile can be different from the injection flow profile.

Because of the so-called heel/toe effect (where frictional pressure causes an inflow/outflow gradient along the length of a production/injection interval), areas of differing permeability or natural or manmade fractures in different parts of the subterranean zone 16, and other effects, the local inflow/outflow rate of fluid with the subterranean zone 16 varies along the production/injection interval. The restriction to flow provided by the flow control devices 26 can be different at different locations along the string 10 to account for this. For example, flow control devices 26 with a lesser resistance to inflow (e.g., having a greater flow area) can be provided in areas of low permeability, and flow control devices 26 with a greater resistance to inflow (e.g., having a lesser flow area) can be provided in areas of high permeability. Flow control devices 26 with a lesser resistance to outflow can be provided in areas of low permeability to facilitate greater stimulation of those areas during injection, while areas already having high permeability would have flow control devices 26 with a higher resistance to outflow. To account for the heel/toe effect, the flow control devices 26 can be provided with a generally decreasing resistance to flow from the heel of the production/injection interval (near the production packer 22) towards the toe of the production/injection interval (and farthest from the production packer 22). Other flow profiles along the production/injection interval can be provided, for example, those that are not necessarily substantially uniform or that may be substantially uniform in injection but not in production or vice versa. Different flow profiles along the production/injection interval can be provided by providing other arrangements of flow control devices 26, including different mixes of one-way flow, asymmetric flow and symmetric flow passages, different numbers of flow control devices (none, one, two, three or more) in each production/injection sub-interval, and/or flow control devices with different flow areas.

The same string 10 can be used in one or both of production of fluids from the subterranean zone 16 and injection of fluids into the subterranean zone 16. In one example, the string 10 is used to inject stimulating fluids (e.g., acid in an acidizing treatment, xylene in a solvent treatment, steam in a heated fluid injection treatment, and/or other types of stimulating fluid) into the subterranean zone 16 substantially uniformly, or in some other flow profile, along the length of the production/injection interval. Thereafter, the string 10 is used to produce fluids (e.g., hydrocarbons and/or other fluids) from the subterranean zone 16 substantially uniformly, or in some other flow profile, along the length of the production/injection interval. In another example, the string 10 is used for injection of sweeping fluids (e.g., water, brine and/or other fluids such as polymer-laden fluids) into the subterranean zone 16 substantially uniformly, or in some other flow profile, along the length of the production/injection interval for the purpose of maintaining pressure in the subterranean zone 16 and sweeping the zone's fluids to a specified location in the subterranean zone 16. The well may be shut-in while the sweeping fluids reside in the subterranean zone 16. In certain instances, the greater resistance or sealing against inflow into the string 10 can limit cross-flow of fluids from one sub-interval, through the string 10 and out to another sub-interval. Thereafter, the string 10 is used to produce fluids (e.g., hydrocarbons and/or other fluids) from the subterranean zone 16 substantially uniformly, or in some other flow profile, along the length of the production/injection interval.

Figure 2A:
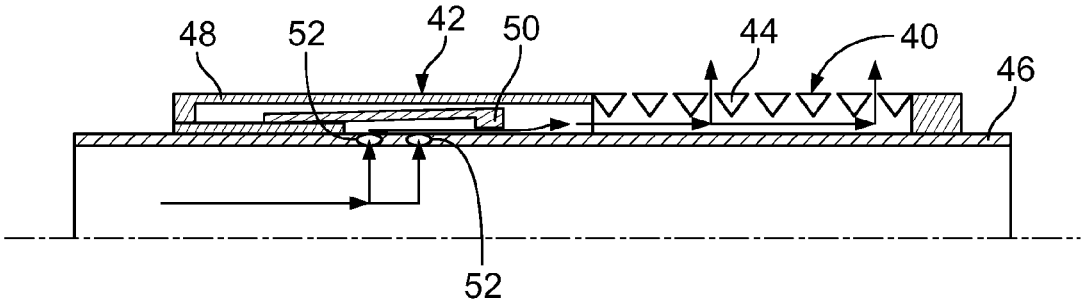
FIGS. 2A-B are schematic detail cross-sectional views of the example production/injection string showing an example particulate control screen and an associated example one-way flow control device.
Figure 2B:
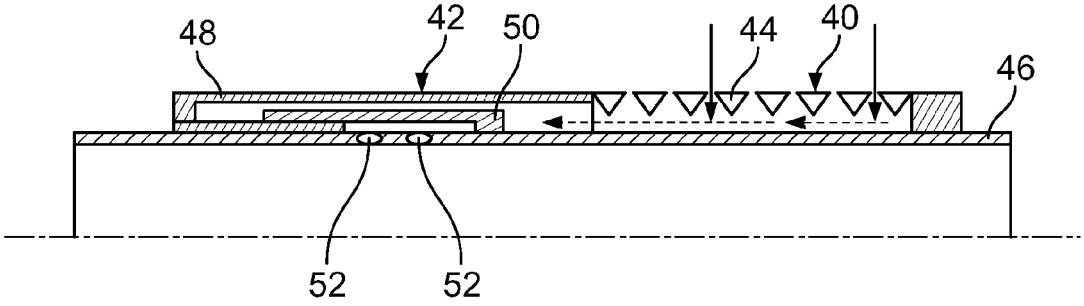

Referring now to FIGS. 2A-B, schematic detail cross-sectional views of the example production/injection string are provided and show an example particulate control screen 40 suitable for use as screen 24 and an associated one-way example flow control device 42 suitable for use as flow control device 26. FIG. 2A depicts outflow from an interior of the string to an exterior of the string (shown by arrows) and FIG. 2B depicts the device's response to inflow from an exterior of the string to an interior of the string (also shown by arrows). In this instance, the particulate control screen 40 is depicted as a wire wrapped screen, having a wire 44 helically wrapped around a base pipe 46. The space between adjacent wraps of the wire 44 is closely controlled to be smaller than the specified size of particulate filtered by the screen 40. The base pipe 46 is configured to couple (threadingly and/or otherwise) with the remainder of the string. Although depicted as a wire wrapped screen, other configurations of screens, including screens having one or more layers of wire wrap, mesh and/or other filtration structures, could be used.

The flow control device 42 has an exterior housing 48 with one end sealed to the base pipe 46 and the other end coupled to the end of the screen 40, such that fluid is communicated from the interior of the housing 48 (between the housing 48 and the base pipe 46) and the interior of the screen 40 (between the wire 44 and the base pipe 46). A flexible sleeve 50 is fit tightly around the base pipe 46 in the interior of the housing 48. In certain instances, the flexible sleeve 50 is polymer, such as butyl rubber, VITON fluoroelastomer (a registered trademark of DuPont Performance Polymers, LLC), and/or other polymer. The end of the sleeve 50 opposite the screen 40 is sealed to the base pipe 46, and the end of the sleeve 50 towards the screen 40 is free. A plurality of circumferentially spaced apertures 52 are provided in the base pipe 46, intermediate the ends of the sleeve 50, that communicate flow between the interior and exterior of the base pipe 46.

As shown in FIG. 2A, when pressure in the interior of the base pipe 46 is higher than the pressure exterior of the base pipe 46, fluid flows from the interior of the base pipe 46, through the apertures 52. The fluid tends to push the free end of the flexible sleeve 50 away from the exterior of the base pipe 46 and passes between the sleeve 50 and the base pipe 46, into the screen 40, and out into the subterranean zone 16. As seen in FIG. 2B, when pressure in the interior of the base pipe 46 is lower than the pressure exterior of the base pipe 46, the pressure differential tends to hold the flexible sleeve 50 into sealing engagement with the exterior of the base pipe 46 thus restricting, and in certain instances sealing against, flow of fluid from the exterior of the base pipe 46 to the interior of the base pipe 46. No intervention into the wellbore or string is required to actuate the flow control device 42 between restricting or sealing against inflow and allowing outflow. Rather, the flow control device is response to pressure and direction of flow.

Although described as a one-way flow control device, the flow control device 42 can alternatively be configured as a two-way flow control device having a greater resistance to flow from the exterior to the interior of the base pipe 46 than from the interior to the exterior of the base pipe 46. For example, additional apertures 52 not covered by the sleeve 50, and thus not restricted to one-way flow, can be included in the base pipe 46. These additional apertures 52 would then allow inflow into the base pipe 46 and thus allow two-way flow. The total flow area through the wall of the base pipe 46 would be greater for outflow from the interior than inflow from the exterior, because during outflow from the interior of the base pipe 46 all apertures 52 (those beneath sleeve 50 and those not covered by the sleeve 50) would be available for flow. During inflow from the exterior of the base pipe 46 the total flow area through the wall of the base pipe 46 would be reduced, because the apertures 52 beneath the sleeve would be restricted or sealed by the sleeve 50.

Figure 3A:
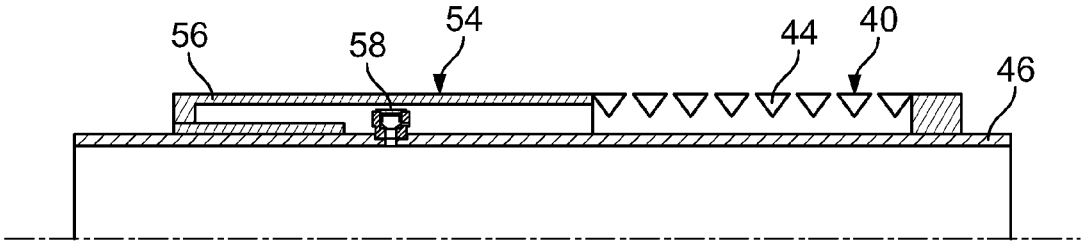
FIGS. 3A-C are schematic detail cross-sectional views of the example production/injection string showing another example one-way flow control device.
Figure 3B:
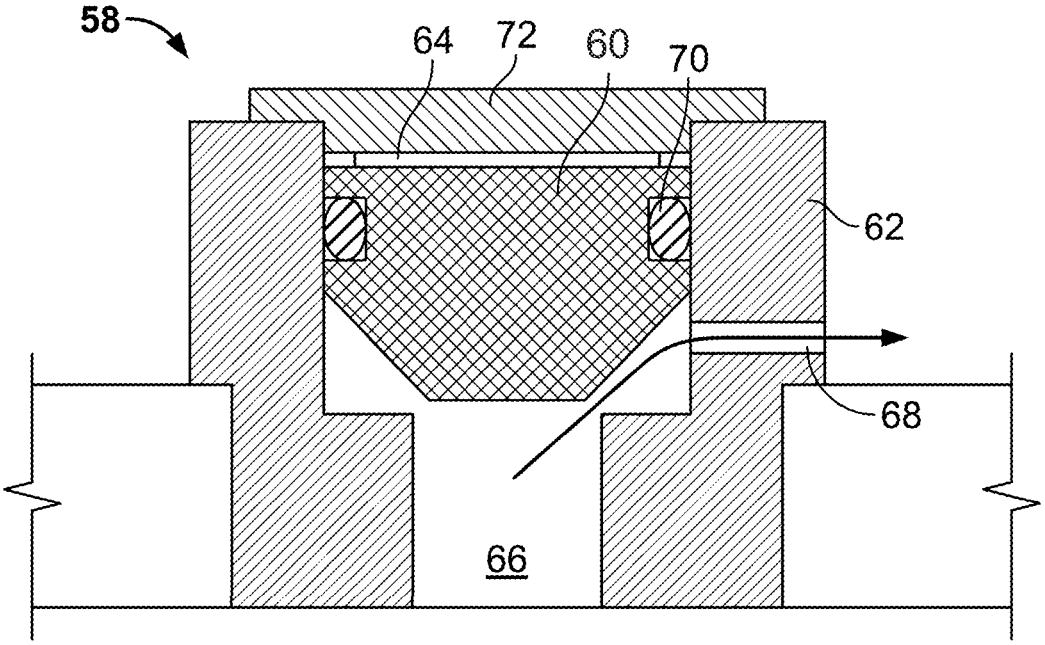
Figure 3C:
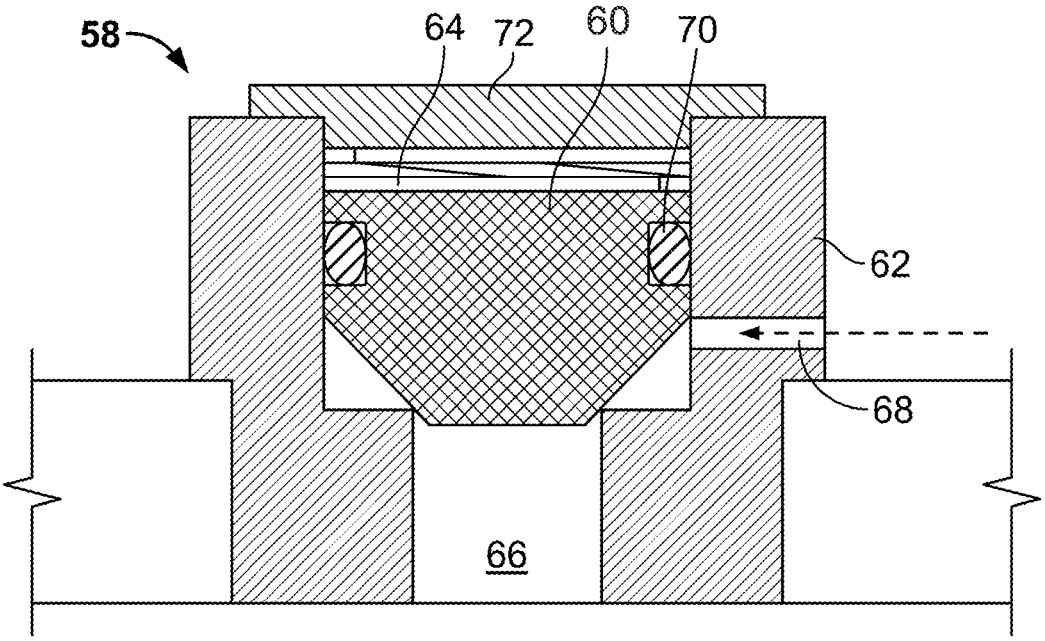

FIGS. 3A-C are schematic detail cross-sectional views of the example production/injection string showing another example one-way flow control device 54 suitable for use as flow control device 26. FIG. 3B depicts outflow from an interior of the string to the exterior of the string (shown by arrows) and FIG. 3C depicts the response of the flow control device 54 to inflow from an exterior of the string to an interior of the string (also shown by arrows).

The flow control device 54 has an exterior housing 56 with one end sealed to the base pipe 46 and the other end coupled to the end of the screen 40 such that fluid is communicated from the interior of the housing 48 (between the housing 48 and the base pipe 46) and the interior of the screen 40 (between the wire 44 and the base pipe 46). A plurality of circumferentially spaced check valves 58 are provided in the wall of the base pipe 46 to communicate flow therethrough. The check valves 58 are configured to allow outflow from the interior of the base pipe 46 (and thus string) to the exterior of the base pipe 46, and close to restrict or seal against inflow from the exterior to the interior of the base pipe 46.

As best seen in FIGS. 3B and 3C, the check valve 58 includes a cylindrical plunger 60 with a frustoconical tip that is carried in cylindrical cavity of a valve housing 62. The valve housing 62 has a bottom port 66 open to the interior of the base pipe 46 and an upper port 68 (shown in the side of the valve housing 62) open to the interior of the flow control device housing 56. The plunger 60 is sealed to the interior diameter of valve housing 62 with a seal 70 (e.g., o-ring and/or other type of seal). The plunger is biased into the bottom port 66 by a spring 64 acting between the plunger 60 and top 72 of the valve housing 62. The top 72 is affixed (threadingly and/or otherwise) to the remainder of the valve housing 62. As shown in FIG. 3B, when pressure is greater in the interior than the exterior of the base pipe 46, flow lifts the plunger 60 and allows outflow of fluid from the interior to the exterior of the base pipe 46. When the plunger 60 is seated in the bottom port 66, the seal 70 is beneath the upper port 68. Thus, when pressure is greater about the exterior than in the interior of the base pipe 46, pressure holds the plunger 60 down. The check valve 58 is thus held closed, and the seal 70 of the plunger 60 seals against inflow from the exterior to the interior of the base pipe 46. No intervention into the wellbore or string is required to actuate the flow control device 54. Rather, the flow control device 54 responds to pressure and direction of flow.

Although described as a one-way flow control device, the flow control device 54 can alternatively be configured as a two-way flow control device having a greater resistance to inflow from the exterior to the interior of the base pipe 46 than outflow from interior to exterior of the base pipe. For example, in addition to the check valves 58, additional apertures can be provided in the base pipe 46. These additional apertures would not be governed by the flow of the check valves 58, and thus would allow two-way flow through the base pipe 46. The total flow area through the wall of the base pipe 46 would then be greater for outflow from interior than inflow from the exterior of the base pipe 46, because both the check valves 58 and the additional apertures would be available for outflow. During inflow from the exterior of the base pipe 46 the total flow area through the wall of the base pipe 46 would be reduced, because the check valves 58 would seal against inflow leaving only the additional apertures available for inflow.

Notably, the flow control devices 42 or 54 can be provided with a different number and/or sizes of apertures 52 or check valves 58 to provide increased or decreased resistance to fluid flow. For example, more apertures 52 or check valves 58 of a given size can be provided to increase the flow area through the wall of the base pipe 46 and provide less resistance to flow. Fewer apertures 52 or check valves 58 and given size can be provided to decrease the flow area and provide more resistance to flow. Similarly, apertures 52 or check valves 58 of a greater flow area can be provided to yield less resistance to flow through the wall of the base pipe 46. Apertures 52 or check valves 58 having a smaller flow area can be provided to provide more resistance to flow through the wall of the base pipe 46. Different configurations of flow control devices, such as flow control devices 42, 54 (in one-way and/or two-way configurations) and/or other configurations of flow control devices (one-way and/or two-way), can be provided to tailor the flow profile along the string.

Other types and configurations of flow control devices can be used in lieu of or in combination with those described above. For example, a fluid diode based valve, such as that described in U.S. patent application Ser. No. 12/700,685, entitled Method and Apparatus for Autonomous Downhole Fluid Selection with Pathway Dependent Resistance System, filed Feb. 4, 2010, or that described in U.S. patent application Ser. No. 12/966,772, entitled Downhole Fluid Flow Control System and Method Having Direction Dependent Flow Resistance, filed Dec. 13, 2010, is a fluidic device that relies on fluid properties (rather than opening and closing a port with a mechanical device) to produce a different resistance to fluid flowing in one direction through the fluid diode than another. By using the fluid diode based valve in a flow control device, it can provide a flow control device with an asymmetrical inflow/outflow. The above-mentioned application describes a number of different configurations of fluid diode based valves, and some are responsive to change resistance to flow based on at least one of the flow rate, viscosity or density of the fluid in addition to flow direction. Thus, for example, by using one of these configurations the flow control devices can become more restrictive of fluid flow as the flow rate increases and less restrictive as the flow rate decreases or vice versa. Also, for example, the flow control devices can become more restrictive of fluid flow as the viscosity fluid increases and less restrictive of viscosity of the fluid decreases or vice versa. Also, for example, the flow control devices can become more restrictive of fluid flow as the fluid density increases and less restrictive as the fluid density decreases or vice versa. In certain instances, thus the flow control devices can automatically be more restrictive to water than oil or vice versa, more restrictive to gas than oil or vice versa, and/or more restrictive to production flow than to injection flow or vice versa.

A number of examples have been described. Nevertheless, it will be understood that various modifications may be made. Accordingly, other examples are within the scope of the following claims.

What is claimed is:

1. A well production and injection string for use in a wellbore, the string comprising:

a plurality of spaced apart flow control devices distributed substantially along a production/injection interval of the string within the wellbore, the wellbore extending from a terranean surface into a target subterranean zone and wherein the portion of the string in the target subterranean zone defines the production/injection interval, the plurality of flow control devices adapted to communicate flow between an interior and an exterior of the string with less restriction to flow from the interior to the exterior of the string than to flow from the exterior to the interior of the string, and wherein the restriction to flow of the flow control devices comprises a fluid diode based valve that accounts for different fluid material properties of injection fluids and production fluids.

2. The well production and injection string of claim 1, wherein the flow control devices comprise a plurality of flow passages between an interior and an exterior of the string and a subset of the passages comprise one-way passages that restrict fluid flow from the exterior to the interior of the string.

3. The well production and injection string of claim 2, wherein the one-way passages comprise check valves adapted to close the passage in response to a pressure differential between the interior and exterior of the string.

4. The well production and injection string of claim 2, wherein a second subset of the passages comprises one-way passages that restrict fluid flow from the interior to the exterior of the string.

5. The well production and injection string of claim 1, wherein the flow control devices define a first flow area available to flow from the interior to the exterior of the string, the flow control devices define a second flow area available to flow from the exterior to the interior of the string, and the first flow area is greater than the second flow area.

6. The well production and injection string of claim 1, further comprising a plurality of spaced apart packers each adapted to seal with a wall of the wellbore; and wherein the plurality of spaced apart packers are distributed along substantially the entire production/injection interval.

7. The well production and injection string of claim 6, comprising only one flow control device between pairs of adjacent packers of at least a subset of the plurality of spaced apart packers.

8. The well production and injection string of claim 6, comprising more than one flow control device between pairs of adjacent packers of at least a subset of the plurality of spaced apart packers.

9. The well production and injection string of claim 1, wherein the flow control devices are adapted to provide substantially uniform flow of fluids between the exterior and the interior of the string along the entire production/injection interval.

10. The well production and injection string of claim 1, wherein the flow control devices are less restricting to flow between the exterior and interior of the string toward an end of the string.

11. The well production and injection string of claim 1, further comprising a plurality of particulate control screens configured to filter against passage of particulate larger than a specified size from the exterior to the interior of the string.

12. The well production and injection string of claim 1, wherein the flow control devices are adapted to produce substantially uniform flow of fluids from the interior to the exterior of the string along the entire production/injection interval.

13. The well production and injection string of claim 1, wherein the flow control devices are adapted to produce substantially uniform flow of fluids from the exterior to the interior of the string along the entire production/injection interval.

14. The well production and injection string of claim 13, wherein the flow control devices are adapted to produce non-uniform flow of fluids from the interior to the exterior of the string along the entire production/injection interval.

15. The well production and injection string of claim 1, wherein a first subset of the flow control devices have a lesser resistance to inflow than a second subset of the flow control devices, and the first subset of the flow control devices is provided in locations of the string adapted to be positioned in areas of a first permeability of the target subterranean zone, and the second subset of the flow control devices is provided in locations of the string adapted to be positioned in areas of a second, higher permeability of the target subterranean zone.

16. The well production and injection string of claim 1, wherein the plurality of flow control devices comprises flow control devices having asymmetrical flow properties between inflow and outflow and flow control devices having symmetrical flow properties between inflow and outflow.

17. The well production and injection string of claim 1, wherein the restrictions to flow of the flow control devices account for different viscosities of injection fluids and production fluids.

18. The well production and injection string of claim 1, wherein the restrictions to flow of the flow control devices account for different fluid types communicated by the flow control device during production and injection.

19. A method of accessing a subterranean zone, comprising:

sealing an annulus between a well string and a wellbore at a plurality of locations;

injecting an injection fluid from the well string into the subterranean zone between the plurality of locations through a first flow area of a flow control device that provides a first flow resistance through the first flow area; and receiving production fluid from the subterranean zone between the plurality of locations through a second flow area of the flow control device that provides a second, greater flow resistance through the second flow area; and wherein the flow control device comprises a fluid diode based valve that accounts for different fluid material properties of the injection fluid and production fluid.

20. The method of claim 19, further comprising reducing the first flow area to yield the second flow area.

21. The method of claim 20, wherein reducing the first flow area comprises sealing a plurality of flow passages of the first area against flow.

22. The method of claim 19, wherein the plurality of locations span between a heel and toe of a wellbore and the first flow resistance is a flow resistance profile that produces a substantially uniform flow of fluid into the subterranean zone between the heel and the toe of the wellbore.

23. The method of claim 22, wherein the first flow resistance profile is greater at the heel of the wellbore than the toe of the wellbore.

24. The method of claim 22, wherein the first flow resistance profile is greater in locations of the subterranean zone having a higher permeability.

25. The method of claim 19, wherein the first flow area is greater than the second flow area.

26. The method of claim 19, wherein injecting an injection fluid comprises injecting at least one of acid, hydrocarbon solvent or steam for stimulating production from the subterranean zone.

27. A well system, comprising:

a wellbore extending from a terranean surface to a subterranean zone;

a well string disposed within the wellbore, wherein the portion of the well string in the subterranean zone defines a production/injection interval of the well string, the well string comprising:

tubing;

a plurality of seals arranged along the tubing and each adapted to seal with a wall of the wellbore; and a plurality of flow control devices arranged along the tubing in the production/injection interval of the well string and distributed between pairs of adjacent seals, the plurality of flow control devices adapted to communicate outflow from an interior to an exterior of the string through a first flow area and inflow from the exterior of the string to the interior of the string through a second, smaller flow area; and wherein the plurality of flow control devices comprises fluid diode based valves that account for different fluid material properties of injection fluids and production fluids.

28. The well system of claim 27, wherein the first flow area comprises a plurality of flow passages between the interior and exterior of the string and the second flow area comprises a subset of the plurality of flow passages.

29. The well system of claim 28, wherein flow passages comprise check valves oriented to seal against inflow into the string.

30. The well system of claim 27, wherein the first flow area is arranged to provide substantially uniform flow into the subterranean zone.

* * * * *